US005816885A

United States Patent [19]

Goldman et al.

[11] Patent Number: 5,816,885

[45] Date of Patent: Oct. 6, 1998

[54] DEFORMABLE SOUND-GENERATING ELECTRONIC TOY

[75] Inventors: Michael J. Goldman, Moorestown, N.J.; Robert W. Jeffway, Jr., Leeds, Mass.

[73] Assignee: Tiger Electronics, Ltd., Pawtucket, R.I.

[21] Appl. No.: 795,439

[22] Filed: Feb. 5, 1997

[51] Int. Cl.[6] ..... A63H 3/28; A63H 5/00

[52] U.S. Cl. ..... 446/397; 446/184; 446/193; 446/302

[58] Field of Search ..... 446/183, 184, 446/190, 191, 297, 299, 300, 302, 303, 370, 371, 397, 408, 484, 409, 193

[56] References Cited

U.S. PATENT DOCUMENTS

| | | | |
|---|---|---|---|
| 3,638,351 | 2/1972 | Kosicki et al. | 446/184 |
| 4,221,927 | 9/1980 | Dankman et al. | 179/1 VC |
| 4,282,681 | 8/1981 | McCaslin | 446/397 |
| 4,305,223 | 12/1981 | Ho | 446/392 |
| 4,451,911 | 5/1984 | Klose et al. | 369/31 |
| 4,595,200 | 6/1986 | Shishido | 273/57 G |
| 4,662,260 | 5/1987 | Rumsey | 84/1.01 |
| 4,737,134 | 4/1988 | Rumsey | 446/409 |
| 4,801,141 | 1/1989 | Rumsey | 273/1 E |
| 4,809,335 | 2/1989 | Rumsey | 381/53 |
| 4,904,222 | 2/1990 | Gastgeb et al. | 446/405 |
| 4,931,029 | 6/1990 | Hwang | 446/396 |
| 5,011,449 | 4/1991 | Handy et al. | 446/297 |
| 5,073,140 | 12/1991 | Lebensfeld et al. | 446/297 |
| 5,260,512 | 11/1993 | Chomette et al. | 84/644 |
| 5,267,886 | 12/1993 | Wood et al. | 446/175 |
| 5,279,514 | 1/1994 | Lacombe et al. | 446/297 |
| 5,281,180 | 1/1994 | Lam et al. | 446/175 |
| 5,288,069 | 2/1994 | Matsumoto | 273/65 EF |
| 5,316,293 | 5/1994 | Hamilton | 273/65 EF |
| 5,375,839 | 12/1994 | Pagani | 273/58 E |
| 5,376,038 | 12/1994 | Arad et al. | 446/297 |
| 5,413,332 | 5/1995 | Montgomery | 273/58 R |
| 5,471,192 | 11/1995 | Dash | 340/384.3 |
| 5,575,240 | 11/1996 | Udelle et al. | 119/707 |

FOREIGN PATENT DOCUMENTS 2 213 069 8/1989 United Kingdom .

*Primary Examiner*—Robert A. Hafer
*Assistant Examiner*—Laura Fossum
*Attorney, Agent, or Firm*—Fitch, Even, Tabin & Flannery

[57] ABSTRACT

A deformable toy is provided for generating sounds having variable acoustic characteristics. The toy includes a deformable body which changes shapes depending on external pressure applied to the body and a sound-reproducing device for playing back either prerecorded or newly recorded sounds, music, messages, etc., which have a predetermined playback rate as recorded to the device. The device is responsive to changes in shape of the body to vary the playback rate of the sounds by way of a mechanism of the sound reproducing device which varies the playback rate for the sounds being played back from the sound reproducing device to provide a highly interactive game for children which allows them to creatively alter sounds generated from the toy herein. In a preferred form, a pressure transmitting medium fills the toy deformable body and an actuator including a piezoelectric transducer and plunger engaging the body and the transducer responds to pressure transmitted through the medium by deforming of the body to shift the plunger, thus stressing the transducer to signal the toy circuitry for altering the sounds played back from the sound reproducing device of the toy.

16 Claims, 4 Drawing Sheets

18
16
20
72
68
42
44
38
24
70
28
74
70a
30
52a
46
52
64
40
62
48a
48
58
54
60
32
34
66
22
36
50

M1 (9MM)1
MIC
52
48
R3 10K
C5 .22u
C6 2.2u
R2 1K
Q1 9013H
Q2 8050D
VCC2
116a
116b
0.1uf1 C6
R1 470K
R7 470
R6
C4 4.7u
LED1 RED
VCC2
C3 .22u
U1
SPK
STPA
STPB
LED1
W528X
VDD
VSS
OSC
TEST
TG1
TG2
TG3
TG4
Vosc
R5 1.2M
100
112
R4 1K
SW1
SW2
SW3
114a
114b
114c
C2 0.1u
28
TO FIG. 5A

DEFORMABLE SOUND-GENERATING ELECTRONIC TOY

FIELD OF THE INVENTION

The invention relates to toys which generate sound, and more particularly, to a toy which can be deformed to alter or warp sounds generated thereby.

BACKGROUND OF THE INVENTION

Toys that have the ability to produce noises and sounds when a child plays with the toy have become extremely popular in recent years with children. In this regard, a number of toys have been developed that speak or talk when a child pushes on a portion of the toy to close switch contacts or moves the toy in a certain manner to activate a sound-generating device thereof. Typically, the sounds or messages are prerecorded so that depending on how the toy is manipulated, the child will receive a predetermined acoustic response from the toy. The acoustic response is normally tied to a predetermined manner of manipulation so that, for instance, pushing on a doll's mouth causes it to say one thing while pushing on the doll's nose causes it to say another. See, e.g., U.S. Pat. No. 5,376,038 to Arad et al. The disadvantage of such toys is that over time, the child becomes familiar with the responses from the toy, thus losing interest in the toy. Moreover, the child learns that pushing on a certain part of the toy will always produce a certain response so that there is no element of creativity for the child in how the toy acoustically responds to their playing with the toy beyond the child deciding which response they want and then manipulating the toy to achieve the desired response.

Toys that allow children to record sounds or messages and then play the recorded sounds/messages back are also known. In this manner, the sounds/messages to be played back can be changed to help keep the child's interest in the toy. However, once the sound/message is played back by activating the sound playing device of the toy, the acoustic characteristics of the sound cannot be altered. In addition, these toys still suffer from the fact that the child has to manipulate the toy in a certain predetermined manner to activate the sound-generating mechanism of the toy, i.e., pushed at a specific location thereon to close switch contacts of the toy. Accordingly, it would be desirable to provide a toy which is more interactive for the child and allows them to be more creative in generating sounds from the toy. Thus, a toy which can be manipulated in a wide variety of manners for altering or warping sounds, music, messages, etc., generated thereby would be desirable.

SUMMARY OF THE INVENTION

In accordance with the present invention, a toy for generating sounds having variable acoustic characteristics is provided with the toy including a deformable body which changes shapes depending on external pressure applied to the body and a sound-reproducing device for playing back sounds having a predetermined playback rate with the device being responsive to changes in shape of the body as it is being deformed to vary the playback rate of the sounds. A mechanism of the sound reproducing device is provided for varying the playback rate for the sounds generated by the sound-reproducing device from the predetermined playback rate in response to changes in shape of the body.

By varying the playback rate, the acoustic characteristics, e.g., pitch, tone, etc., of the sounds are altered as the deformable body is squeezed or pulled by the player. Thus, the present invention allows a player to vary the acoustic characteristics of sounds which are generated by the toy simply by squeezing or pulling the toy to deform the body portion thereof. This provides a child with a more interactive game than previously provided in sound-generating toys and also for a more interesting game for the child as the sound varies according to the pressure applied to the toy. Because the toy produces sounds based on the shape taken by the deformable body upon applying pressure thereto, the sounds necessarily can take on a practically infinite number of different acoustic characteristics as the deformable body of the toy changes shape thus allowing the child to exercise a great deal of creativity in altering the sounds from the toy producing a more entertaining toy for the child.

The deformable body can be filled with a pressure-transmitting medium so that deforming the body portion by application of external pressure to the body portion causes the fluid to transmit the external pressure to the playback rate varying mechanism of the sound-reproducing device for varying the acoustic characteristics of the sounds generated by the sound-reproducing device. Filling the body portion with a pressure-transmitting fluid ensures that pushing or pulling on the body at one portion will transmit the pressure applied to the body throughout the body and to the playback rate varying mechanism for varying of the playback rate of the generated sound.

The varying mechanism of the sound-reproducing device includes circuitry having different electrical states which varies the playback rate of the generated sounds depending on its electrical state, and an actuator responsive to changes in shape of the deformable body to change the state of the circuitry for varying the playback rate of the generated sounds.

In a preferred form, the sound-reproducing device can include a microcontroller including a memory device for storing the playback rate. The varying mechanism can include an oscillator for timing the microcontroller. The actuator modulates the output of the oscillator to vary the timing of the microcontroller.

The sound-reproducing device can include mechanisms for playing back prerecorded and newly recorded sounds. Thus, the player can warp prerecorded sounds such as sound effects that are prerecorded into the sound-reproducing device of the toy and can also warp sounds that they record into the sound-reproducing device, such as new sounds, music or messages.

In another form of the invention, a toy is provided having a mechanism for playing back recorded sounds with deforming the toy changing the acoustic characteristics of the recorded sounds being played back. The toy includes a substantially shape-retentive deformable portion which has a non-deformed predetermined shape and which can be squeezed or pulled to change the shape of the toy deformable portion from the non-deformed predetermined shape. A pressure-transmitting medium is provided in the toy deformable portion. A sound altering device is electrically connected to the sound playback mechanism and senses pressure changes in the pressure-transmitting medium to change the acoustic characteristics of the recorded sounds being played back as the toy deformable portion is squeezed or pulled to change its shape from the non-deformed predetermined shape thereof.

The deformable body can include an outer flexible casing in which the pressure-transmitting medium is contained with the pressure-transmitting medium being a liquid medium filling the outer flexible casing.

In one form, a substantially rigid housing portion is provided for containing the sound playback mechanism with the rigid housing portion being attached to the deformable portion. The sound altering device includes an actuator coupled to the deformable body portion and to the sound playback mechanism in the rigid housing for being responsive to pressure changes in the pressure-transmitting medium in the deformable portion to vary the acoustic characteristics of the recorded sounds being played back as the toy deformable portion is squeezed.

The actuator can include a piezoelectric transducer in the rigid housing and a plunger with the plunger having one end engaging the deformable body and another end engaging the transducer. The plunger shifts positions in response to changes in shape of the deformable body portion and exerts a mechanical stress on the transducer as it is being shifted for sensing pressure changes in the pressure-transmitting medium to vary the acoustic characteristics of the recorded sounds being played back as the toy deformable portion is squeezed or pulled.

In another form of the invention, an electronic toy having internal circuitry for generating different sounds is provided and includes a deformable body and a substantially rigid housing for containing the toy internal circuitry and which is attached to the deformable body. External wall portions of the body and housing are accessible to a player with pressure applied by the player to the body external wall portion causing the body to change configurations from the predetermined undeformed configuration. Internal wall portions of the body and housing are connected to their respective external wall portions and are not accessible to the player. A pressure-transmitting medium fills the deformable body so that pressure applied to the body external wall portion causes the body internal wall portion to shift. An actuator extends between the body and housing internal wall portions and to within the housing and is electrically connected to the housing internal circuitry so that when pressure is applied to the body external wall portion the actuator senses shifting of the body internal wall portion as the deformable body changes configurations and provides an electrical signal to the circuitry based on the shifting to change the acoustic characteristics of the sounds being generated by the toy.

DETAILED DESCRIPTION OF THE PREFERRED EMBODIMENT

Figure 1:
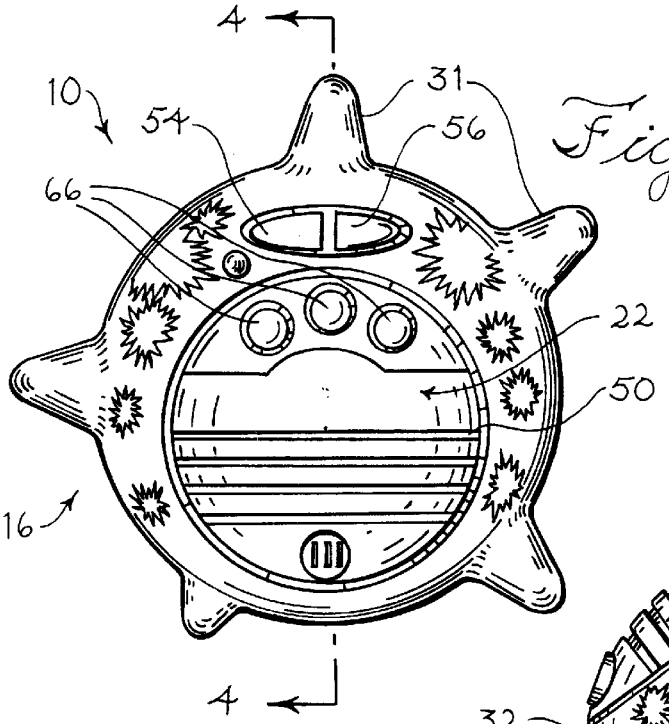
FIGS. 1–3 are elevational views from various locations around a toy according to the present invention showing the toy having a deformable body portion thereof.
Figure 2:
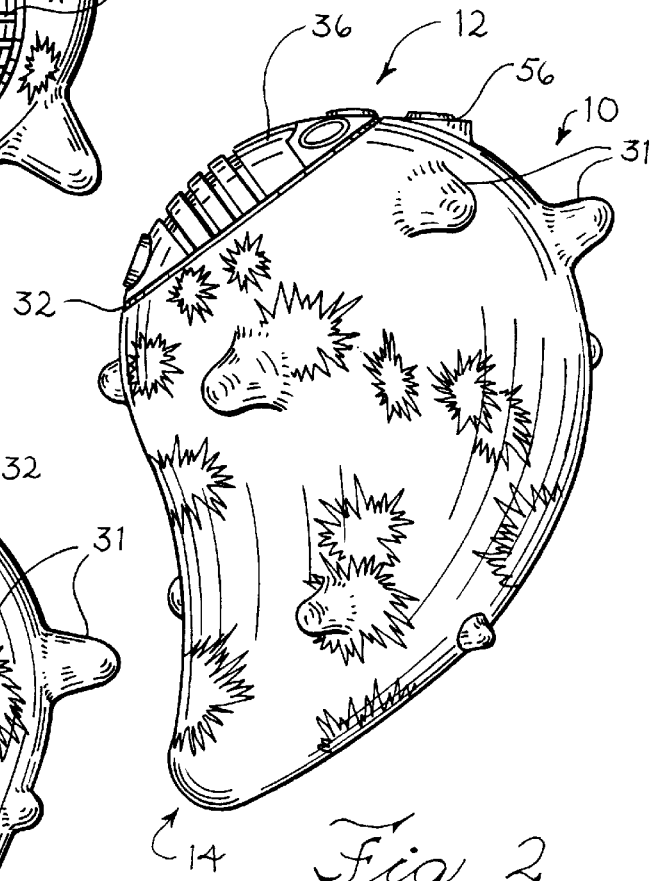
Figure 3:
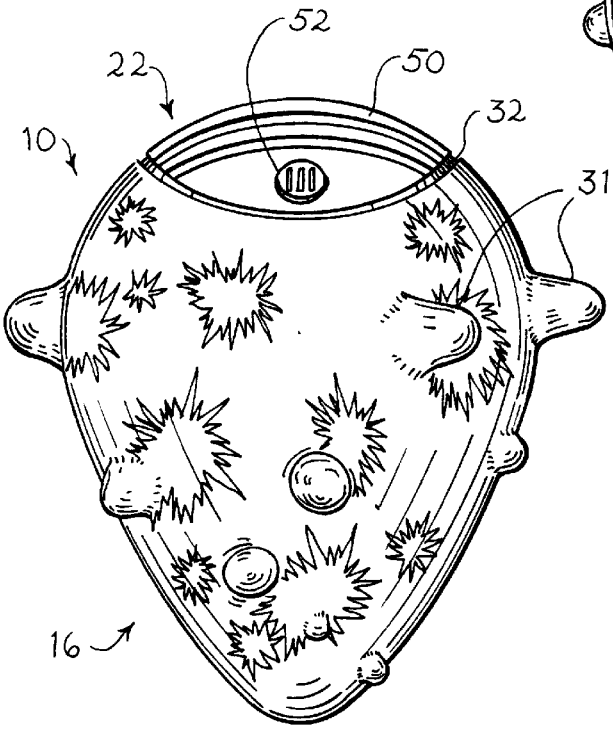

Referring to FIGS. 1–3, a squeeze toy 10 in accordance with a preferred form of the present invention is illustrated. As can be seen in the Figures, the toy 10 has a elongated shape with a rounded end 12 and a more pointed end 14, although the exact shape of the toy 10 can take on a wide variety of forms without departing from the invention herein. The squeeze toy 10 has a deformable body portion 16 having an outer flexible casing 18 filled with a pressure transmitting medium 20 so that the body portion 16 changes shape from its illustrated undeformed shape when external pressure is applied thereto, such as by a child pushing or pulling on the flexible casing membrane 18. When the pressure is released from the casing 18, the body portion 16 will return to its original undeformed shape. The flexible casing 18 can be of a soft material such as formed from a rubber membrane while the pressure transmitting medium 20 can be a fluid or liquid medium, such as a liquid which has some viscosity to it and which is safe for use in children's toys, such as corn syrup. The use of a viscous fluid is effective to transmit pressure throughout the deformable body 16 while providing a slight resistance to the pressure due to the fluid viscosity so that a child must exert some force to deform the body 16 from its undeformed shape.

The deformable body portion 16 is attached to a substantially rigid plastic housing portion 22 of the toy 10 which includes a sound-reproducing device or a recorded sound playback mechanism 24 therein. Sounds are recorded to the sound-reproducing device 24 with acoustic characteristics such as pitch, tone, etc., as determined by their predetermined playback rate. The sound-reproducing device 24 includes mechanisms for playing back both prerecorded and newly recorded sounds, as will be more fully described herein. The sound-reproducing device 24 also includes a sound-altering device or mechanism for varying the sound playback rate 26 for the sounds generated and played back by the sound-reproducing device 24.

The sound-altering device 26 is effective to sense pressure changes in the pressure-transmitting medium 20 for changing the acoustic characteristics of the recorded sounds being played back by the sound-reproducing device 24 as the toy deformable portion 16 is squeezed or pulled to change its shape from the non-deformed predetermined shape thereof. Circuitry 28 for the sound-reproducing device 24 including the sound-altering device 26 is provided such as on printed circuit board (PCB) contained in rigid housing 22 with the circuitry being illustrated schematically in FIGS. 5A and 5B. The circuitry 28 also includes portions thereof for playing back prerecorded sounds, such as sound effects as will be more fully described herein, and for recording new sounds, music or messages to be played back. Thus, the present invention provides the child with a highly interactive toy 10 which allows them to use their creativity in creating different sounds from the recorded sounds by manipulation of the deformable body portion 16, such as by squeezing on the flexible casing 18 thereof, or by pulling on the casing 18, such as by gripping projections 31 formed on the casing 18 and pulling thereon. Such deforming of the body portion 16 changes the pressure in the pressure-transmitting medium 20 to vary the pressure throughout the deformable body portion 16 which is sensed by the sound-altering device 26 for changing the acoustic characteristics of the recorded sounds being played back from the toy 10.

A more detailed description of the preferred and illustrated form of the toy 10 will next be provided by reference to FIGS. 1–4. As previously mentioned, the deformable body portion 14 is attached to rigid housing 22. To attach the body 16 to the rigid housing 22, an internally threaded locking ring 32 is attached to the flexible casing 18 at the rounded end 12 of the toy and is threaded onto external threads 34 provided on the rigid housing portion 22 around the housing cover 36 thereof. The rigid housing 22 includes an interior wall portion 38 with an annular groove portion 40 formed therearound adjacent the threads 34 on the other side of the threads 34 from the external cover wall portion 36 of the housing 22. The flexible casing 18 is constructed with an external wall portion 42 and an internal wall portion 44 with the body internal wall portion 44 adjacent the housing internal wall portion 38. The body internal wall portion 44 has an annular raised rib portion 46 which fits tightly in the grooved portion 40 of the housing internal wall portion 38 when the lock ring 32 is screwed onto the threads 34 of the housing 22.

As previously mentioned, the housing 22 contains the circuitry 28 for the game such as on PCB 30 mounted therein. Components for the sound playback and recording mechanisms are electrically connected to the circuitry 28 in the housing 22. For reproducing or playing back sounds, a speaker 48 is mounted in the housing 22 just below the housing cover 36 and, more particularly, a slotted portion 50 thereof for serving as the speaker grill. Leads 48*a* electrically connect the speaker 48 to the toy circuitry 28 on the PCB 30. For recording new sounds, a microphone 52 is mounted to the housing cover 36 and is electrically connected by leads 52*a* to the toy circuitry 28 on the PCB 30.

Figure 4:
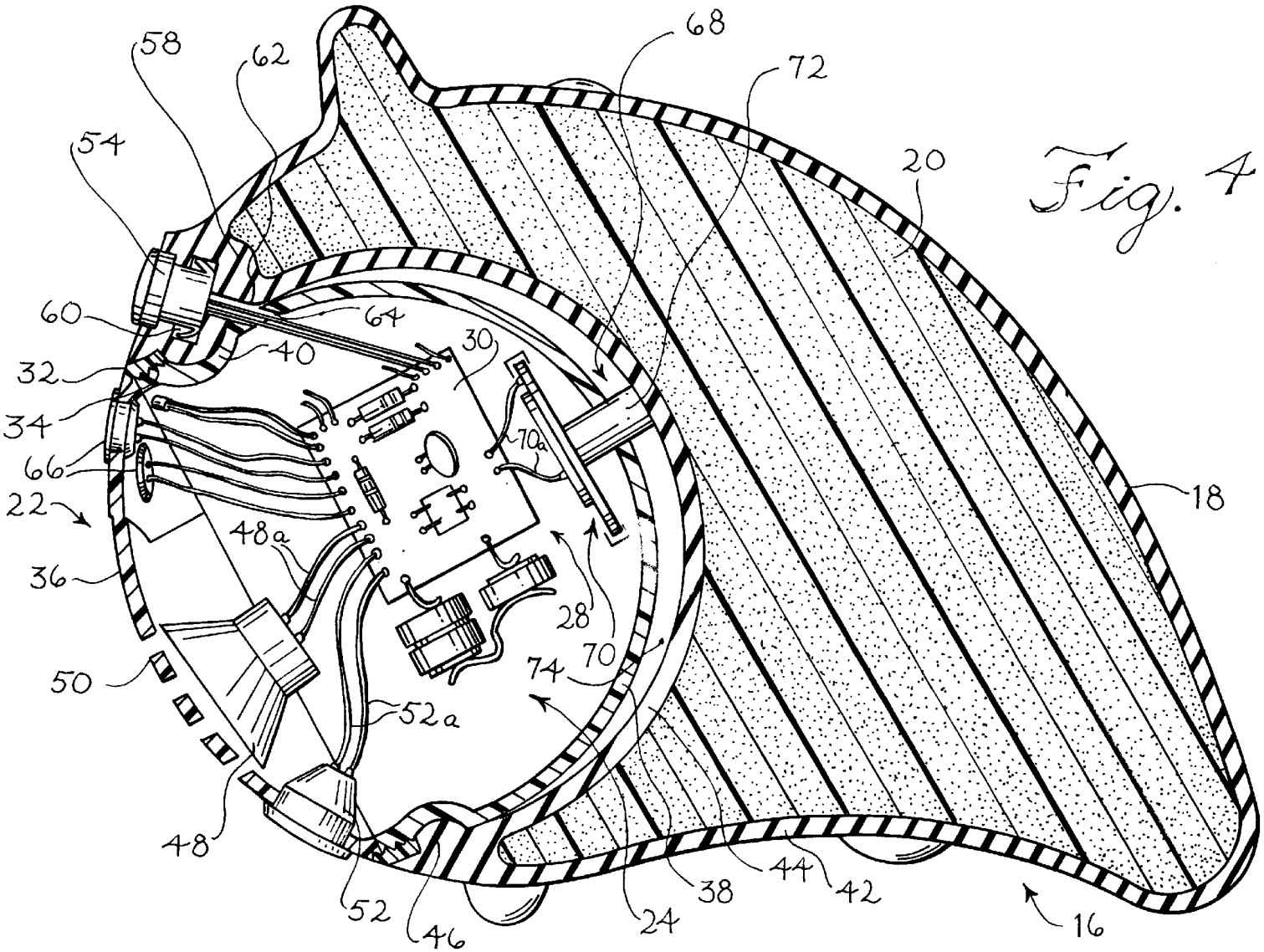
FIG. 4 is a sectional view taken along line 4—4 of FIG. 1 showing the attachment between the deformable body portion to a housing portion for the sound playback mechanism of the toy.

To utilize the microphone 52 for recording new sounds and the speaker 48 for playing back the newly recorded sounds, the toy 10 is provided with a record button 54 and a play button 56 which preferably are mounted to the casing 18 of the deformable body portion 16 at a location adjacent to the housing cover 36. As best seen in FIG. 4, the casing 18 is provided with a thickened region 58 adjacent the body raised rib 46 so as to be less flexible thereat for assembly of the body portion 16 to the housing 22 and to provide for mounting of the record and play buttons 54 and 56 therein. A mounting opening 60 can be formed in the thickened region 58 for receiving bodies of the record and play buttons 54 and 56 with the thickened region 58 and the housing interior wall portion 38 being provided with aligned lead-receiving openings 62 and 64 which communicate with the mounting opening 60 so that leads from the record and play buttons 54 and 56 can be extended into the interior of the housing 22 for connecting to the internal circuitry 28 on the PCB 30 therein. Thus, to record, the record button 54 is pressed down and a source of sound, music, messages, etc., is placed near the microphone 52 so that the sound emanating from the source enters the microphone 52 and is recorded for being played back by pushing the play button 56 thereafter.

In addition, provision is made for playing back prerecorded sounds in the form of sound effects that are recorded into the toy circuitry 28 during manufacture of the toy 10. To play the sound effects through the speaker 48, sound effects buttons 66 are mounted to the housing cover wall portion 36 so that pressing one of the sound effects buttons 66 causes the particular sound effect associated with that button to be played through the toy speaker 48.

To change the acoustic characteristics of either the prerecorded or recorded sounds being played back through the speaker 48, the sound-altering device 26 includes an actuator 68 which is responsive to changes in shape of the deformable body portion 16 to vary the acoustic characteristics of the recorded sounds being played back as the casing 18 of the deformable body portion 16 is being squeezed or pulled. More specifically, the actuator 68 includes a piezoelectric transducer 70 mounted in the housing 22 and electrically attached to the toy circuitry 28 on the PCB 30 by leads 70*a*. A plunger 72 of preferably foam material is engaged with the body interior wall portion 44 at one thereof and extends through space 74 between the body interior wall portion 44 and the housing interior wall portion 38 and into the interior of the housing 22 so that its other end is engaged with the piezoelectric transducer 70 in the housing 22.

For altering the sounds generated by the toy 10, the player applies pressure to the body external wall portion 42 which will be transmitted to the body internal wall portion 44 by the pressure transmitting medium 20 so as to cause the body internal wall portion 44 to shift based on the transmitted pressure as the body 16 changes shapes. The shifting of the body internal wall portion 44 causes the plunger 72 engaged therewith to shift, thus exerting a mechanical stress on the piezoelectric transducer 70 at the other end of the plunger 72. This mechanical stress on the transducer 70 is converted into electrical signals so that deforming the body 16 causes the transducer 70 to signal the circuitry 28 for changing the acoustic characteristics of the sounds generated by the toy 10, as will be more specifically described with reference to the schematic diagrams of the toy circuitry 28 shown in FIGS. 5A and 5B.

Figure 5A:
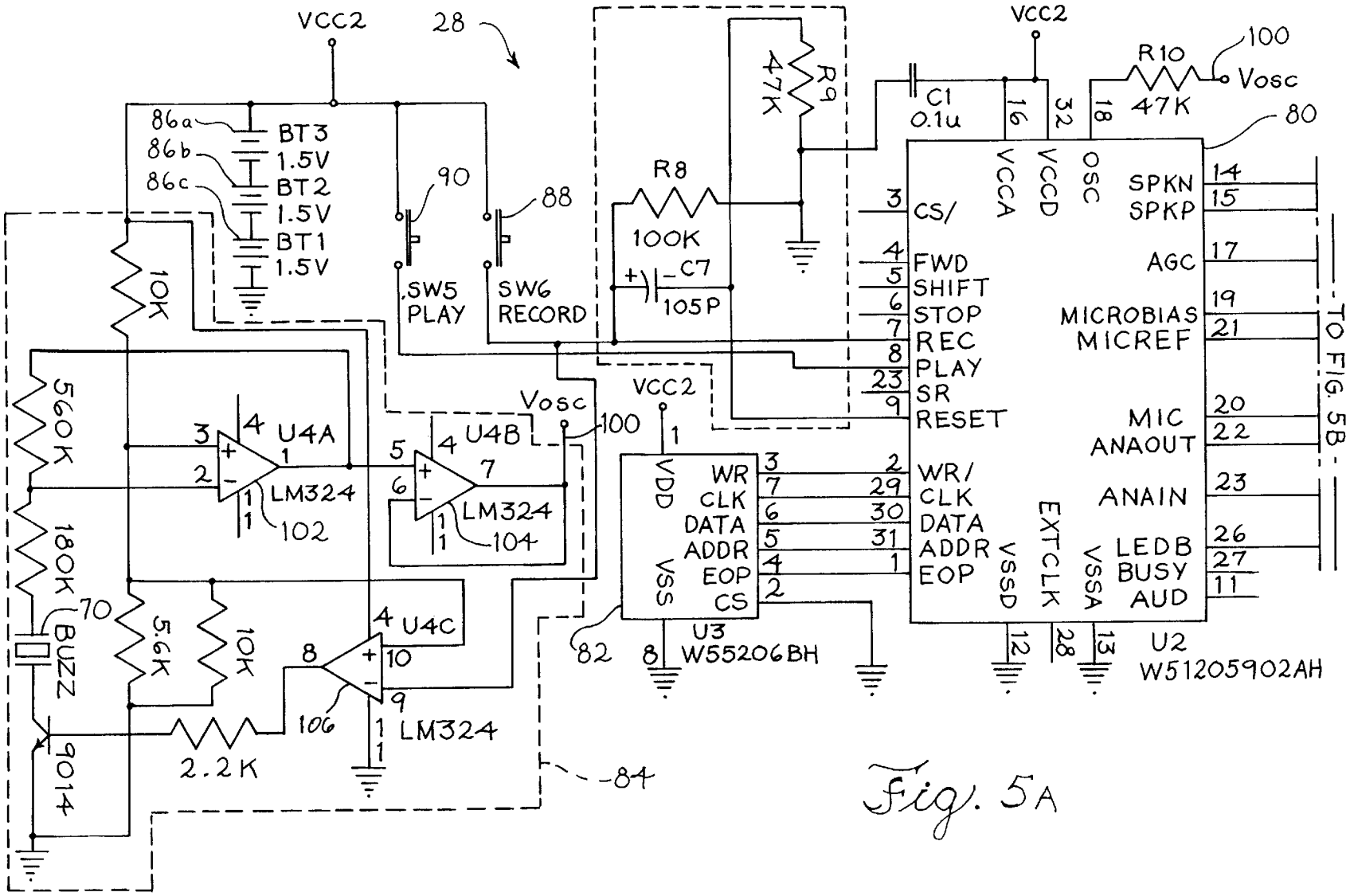
FIGS. 5A and 5B are schematic views of the circuitry for the toy in accordance with the present invention.
Figure 5B:
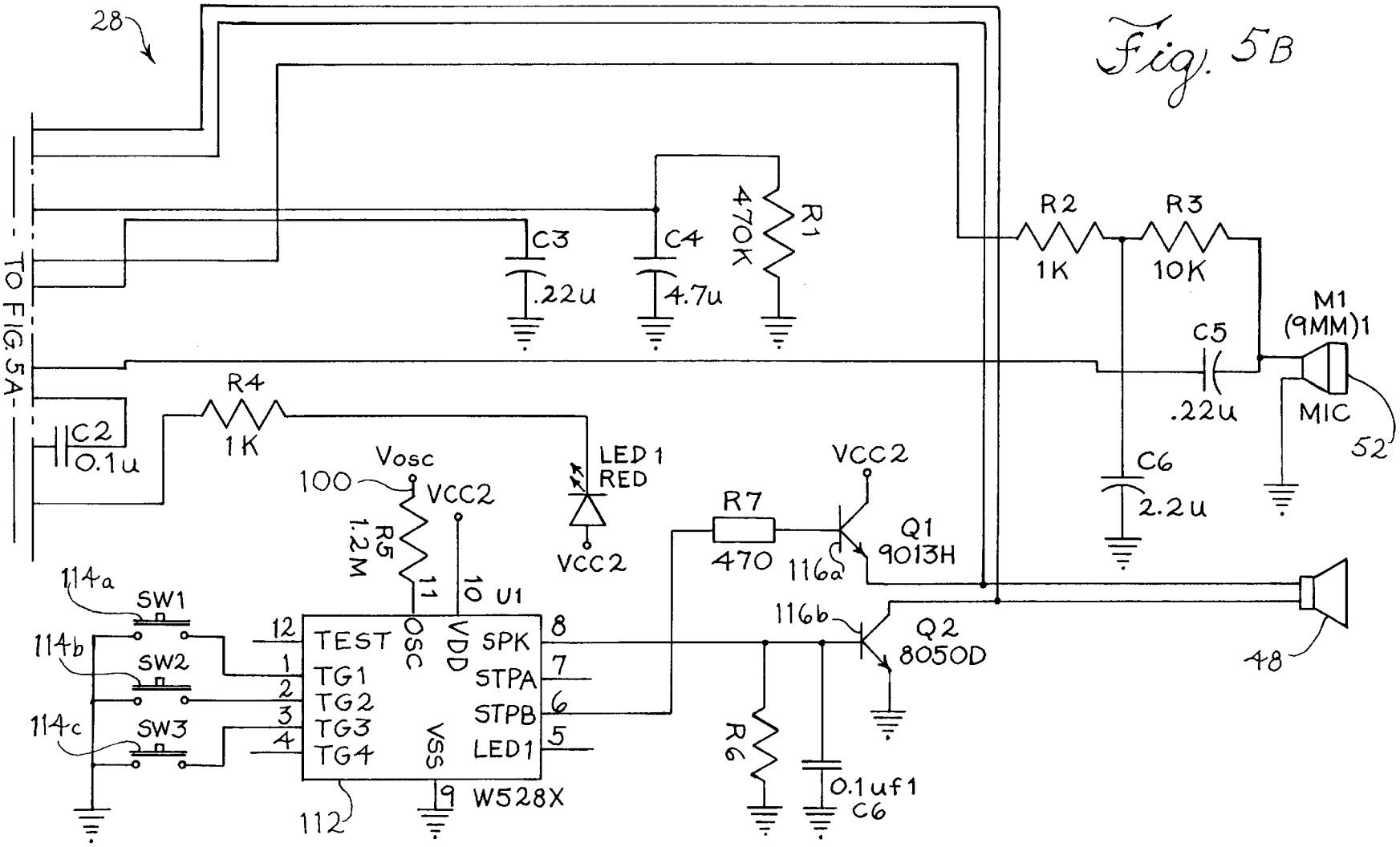

Turning now to FIGS. 5A and 5B, the circuitry 28 of the squeeze toy 10 is illustrated in schematic diagram form, and the sound-reproducing device of the described embodiment includes a microcontroller 80 and a memory device 82 for storing the recorded signal. An oscillator circuit 84 is shown in dashed lines, which oscillator 84 provides timing i.e., clock signals for the microcontroller 80. Thus, the oscillator 84 for generating clock signals for timing the microcontroller 80 provides a varying mechanism for varying the playback rate of audio signals from the memory device 82 using the microcontroller 80, by varying the rate of the clock signals from the oscillator 84.

The circuitry 28 is powered by three AAA 1.5 v batteries 86*a*, 86*b* and 86*c*, and operation of the microcontroller 80 is switched between the record and play states using the pushbutton switches 88 and 90, which correspond to the mechanical record and play buttons 54 and 56, respectively, on the housing 22 as described above. Again, the microcontroller 80 is timed by using a clock signal from the oscillator 84 when, in particular, $V_{osc}$, i.e., clock signal 100 which is provided to the oscillator input or clock input of the microcontroller 80. The clock signal 100 is derived from the oscillator circuit 84 using operational amplifiers 102, 104 and 106 which provide a closed-loop feedback oscillator circuit wherein the piezoelectric transducer 70 is employed as an element in the feedback path of the oscillator circuitry setting the threshold at the input of operational amplifier 102 of the oscillator 84. Thus, mechanical stressing of the piezoelectric transducer 70 by the shifting of the plunger 72 in response to the changing shapes of the body 16 effects the oscillator output, the $V_{osc}$, i.e., clock output 100 of the oscillator 84 as a varying mechanism to alter the timing of the microcontroller 80 in that varying of the clock signal 100 varies the playback rate of audio signals stored in the memory 82 for reproduction using the microcontroller 80. Accordingly, a sound-reproducing device for playing back recorded sounds having a predetermined playback rate with the device being responsive to changes in the shape of the body 16 as it is being deformed by external pressure to vary the playback rate of the sound is provided. Manipulation or varying of the clock signal 100 is provided in the described embodiment with the piezoelectric transducer 70 in oscillator 84 to vary clock signal 100 to microcontroller 80. Thus, the mechanism of the sound-reproducing device for varying the playback rate of the sounds generated by the sound-reproducing device from their predetermined playback rate in response to changes in the shape of the body is provided by way of the oscillator 84 altering the timing of the microcontroller 80 for replay of the audio signals stored in the memory 82.

In recording audio signals, the microphone 52 is provided. The microphone 52 is interfaced with the microcontroller 80 via an on-board analog-to-digital converter (ADC) provided on the microcontroller 80 for receiving audio signals using the microphone 52.

Audio output signals from the microcontroller 80 are provided to the speaker 48 using positive and negative output leads from the microcontroller 80 for driving the speaker 48. Alternatively, as audio signal components are superimposed thereon, a preprogrammed audio sound effect chip or effects 112 is also provided for driving the speaker 48. The effects chip 112 provides switches 114*a,* 114*b* and 114*c,* corresponding to the sound effects buttons 66 on the housing 22, coupled thereto for selecting various predetermined recorded audio effects. The clock signal 100 also controls the timing of the effects chip 112. Thus, varying of the clock signal 100 by deforming the toy 10, similarly changes the rate of replay from the effects chip 112 to distort its audio output. The speaker output of the effects chip 112 drives the speaker 48 via transistors 116*a* and 116*b* which couple audio electrical signals across the speaker output of the microcontroller 80 to provide electrical signals to the speakers 48.

Thus, the toy 10 allows a child to creatively distort and manipulate sounds or music by squeezing and/or pulling on the pliable casing 18 of the toy 10. The words and/or sounds reproduced are warped in direct relationship to how the toy 10 is deformed by the player. The sound effects buttons 66 can generate music riffs and other music can be recorded utilizing the record button 54 and microphone 52 so that by selectively pressing the sound playback buttons 66 and 56, the child can orchestrate a variety of creative sounding music in conjunction with squeezing and/or stretching of the toy casing 18.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. A toy for generating sounds, the toy comprising:

a deformable body of the toy having an interior and which changes shapes with the shape depending on external pressure applied thereto;

means for recording sounds by storing the sounds as audio signals having a predetermined playback rate;

a sound-reproducing device in the toy body interior for playing back the recorded sounds with the device being responsive to changes in shape of the body as it is being deformed by external pressure to vary the recorded sounds being played back; and a mechanism of the sound reproducing device for varying the playback rate of the stored audio signals for the sounds being played back by the sound-reproducing device from their predetermined playback rate the playback rate varying mechanism including a substantially rigid mechanical actuator member in the interior of the toy body and which shifts in response to changes in shape of the body with the shifting of the rigid actuator member controlling the playback rate so that the playback rate varies depending on the extent of shifting of the actuator member as caused by the changing shape of the body.

2. The toy of claim 1 wherein the deformable body is filled with a pressure-transmitting liquid fluid so that deforming the body by application of external pressure to the body portion causes the fluid to transmit the external pressure to the rigid actuator of the varying mechanism of the sound-reproducing device for varying the playback rate of the sounds generated by the sound-reproducing device.

3. The toy of claim 2 wherein the varying mechanism of the sound-reproducing device comprises circuitry having different electrical states which varies the acoustics of the generated sounds depending on its electrical state with the actuator changing the state of the circuitry for varying the playback rate of the generated sounds as the actuator shifts in response to changes in shape of the body.

4. The toy of claim 3 wherein said sound-reproducing device comprises a microcontroller including a memory device for storing the playback rate and said varying mechanism comprises an oscillator for timing said microcontroller, wherein said actuator modulates the output of said oscillator to vary the timing of said microcontroller.

5. The toy of claim 4 including a substantially rigid housing portion for containing the sound-reproducing device with the rigid housing portion being attached to the deformable body, and the actuator being coupled to the sound-reproducing device and extending between the rigid housing and the deformable body with the actuator being responsive to changes in shape of the deformable body for varying the playback rate of the generated sounds.

6. The toy of claim 5 wherein the actuator includes a plunger and a piezoelectric transducer with the plunger having one end engaging the deformable body and another end engaging the transducer for exerting a mechanical stress thereon when the body is deformed and undergoing shape changes.

7. The toy of claim 1 wherein the recording means includes a first device for recording and storing audio signals that can be recorded over with different signals and a second device for prerecording and permanently storing audio signals that can not be recorded over with different signals.

8. A toy having a mechanism for playing back recorded sounds with deforming the toy changing the acoustic characteristics of the recorded sounds being played back, the toy comprising:

a substantially shape-retentive deformable portion of the toy having an interior and a non-deformed predetermined shape and which can be squeezed or pulled to change the shape of the toy deformable portion from the non-deformed predetermined shape;

a pressure-transmitting medium in the toy deformable portion interior; and a sound altering device electrically connected to the sound playback mechanism and having a mechanical actuator which shifts in response to pressure changes in the pressure-transmitting medium to change the acoustic characteristics of the recorded sounds being played back such that the played back recorded sounds are made to vary depending on how the toy deformable portion is squeezed or pulled to change its shape from the non-deformed predetermined shape thereof.

9. The toy of claim 8 wherein the deformable body includes an outer flexible casing in which the pressure-transmitting medium is contained with the pressure-transmitting medium being a liquid medium filling the outer flexible casing.

10. The toy of claim 8 including a substantially rigid housing portion for containing the sound playback mechanism with the rigid housing portion being attached to the deformable portion, and the sound altering device actuator is coupled to the deformable body portion to shift in response to pressure changes in the pressure-transmitting medium in the deformable portion interior to vary the acoustic characteristics of the recorded sounds being played back as the toy deformable portion is squeezed or pulled.

11. The toy of claim 10 wherein the actuator includes a piezoelectric transducer in the rigid housing and a plunger with the plunger having one end engaging the deformable body and another end engaging the transducer with the plunger shifting positions in response to changes in shape of the deformable body portion and exerting a mechanical stress on the transducer as it is being shifted for sensing pressure changes in the pressure-transmitting medium to vary the acoustic characteristics of the recorded sounds being played back as the toy deformable portion is squeezed or pulled.

12. The toy of claim 8 wherein the sound altering device changes the pitch and tone of the recorded sounds as they are being played back and the toy deformable portion is being squeezed or pulled.

13. An electronic toy having an interior and an exterior thereof with circuitry in the toy interior for generating different sounds, the toy comprising:

a deformable body having a wall with an undeformed shape where the body wall has a predetermined configuration and a deformed shape where the body wall has a configuration different from the predetermined configuration;

a substantially rigid housing having a wall defining an enclosure for containing the toy circuitry and being attached to the deformable body;

external wall portions of the body and housing that are exposed on the exterior of the toy with pressure applied to the body external wall portion causing the body wall to change configurations from the predetermined undeformed configuration;

internal wall portions of the body and housing connected to their respective external wall portions that are disposed in the interior of the toy;

a pressure-transmitting medium filling the deformable body so that pressure applied to the body external wall portion causes the body internal wall portion to shift; and an actuator extending between the body and housing internal wall portions and to within the housing and being electrically connected to the housing internal circuitry with the actuator including an elongate rigid mechanical member so that when pressure is applied to the body external wall portion the elongate actuator member shifts due to shifting of the body internal wall portion as the deformable body changes configurations and controls an electrical signal provided to the circuitry that is variable based on the extent of the elongate actuator member shifting to change the acoustic characteristics of the sounds being generated by the toy.

14. The electronic toy of claim 13 wherein the actuator includes a piezoelectric transducer in the rigid housing and the mechanical actuator member is a plunger engaging the body internal wall portion and the transducer with the plunger shifting as the body internal wall portion shifts to exert a mechanical stress on the transducer which signals the circuitry for changing the acoustic characteristics of the sounds generated by the toy.

15. The electronic toy of claim 13 wherein the pressure-transmitting medium is a liquid medium.

16. The electronic toy of claim 13 wherein the internal circuitry includes a mechanism to playback recorded sounds having acoustic characteristics that are varied as the configuration of the deformable body changes.

* * * * *